US006760920B1

(12) United States Patent
Kadymir et al.

(10) Patent No.: US 6,760,920 B1
(45) Date of Patent: Jul. 13, 2004

(54) DISPOSABLE UNDERARM PERSPIRATION PAD

(76) Inventors: Jack Kadymir, 448 Neptune Ave., #16 J, Brooklyn, NY (US) 11224; Richard Schweitzer, 3569 W. Atlantic Blvd., #213, Pompano Beach, FL (US) 33069

( * ) Notice: Subject to any disclaimer, the term of this patent is extended or adjusted under 35 U.S.C. 154(b) by 0 days.

(21) Appl. No.: 10/216,686

(22) Filed: Aug. 12, 2002

(51) Int. Cl.[7] ..... A41D 27/13
(52) U.S. Cl. ..... 2/53; 2/56
(58) Field of Search ..... 2/53, 54, 55, 56, 2/57, 58, 455, 267, 268; 604/385.201, 358, 385.03, 385.01, 385.16, 386, 387, 388, 390, 391, 393

(56) References Cited

U.S. PATENT DOCUMENTS 726,357 A * 4/1903 Schultz ..... 2/53
2,556,231 A * 6/1951 Stephens ..... 2/53
3,141,174 A * 7/1964 Meier-Nieper ..... 2/53
3,145,391 A * 8/1964 Tyrell, Jr. ..... 2/56
3,156,924 A * 11/1964 Wonacott ..... 2/53
3,997,920 A * 12/1976 DeWoskin ..... 2/53
4,631,752 A * 12/1986 Heyman et al. ..... 2/56
5,042,089 A * 8/1991 Carmer ..... 2/55
5,790,982 A * 8/1998 Boutboul et al. ..... 2/53
5,884,330 A * 3/1999 Erlich ..... 2/53
6,269,486 B1 * 8/2001 Nager et al. ..... 2/53

* cited by examiner

*Primary Examiner*—John J. Calvert
*Assistant Examiner*—Alissa L Hoey
(74) *Attorney, Agent, or Firm*—Myron Amer P.C.

(57) ABSTRACT

An underarm perspiration pad that straddles the lower edge of a sleeve opening positioning one inner semi-circular ply on one side within the garment and another outer semi-circular ply on the other side within the sleeve, and in the outer ply there are radially oriented unfolded pleats which in response to pivotal arm movements assume folded conditions and thus offer a least resistance impeding these arm movements.

1 Claim, 2 Drawing Sheets

DISPOSABLE UNDERARM PERSPIRATION PAD

The present invention relates generally to improvements for a disposable underarm perspiration pad, the improvements more particularly contributing to obviating inhibiting of arm movement, and even awareness by the user of its presence in its underarm location.

EXAMPLE OF THE PRIOR ART

For personal hygiene and even for more utilitarian reasons, such as lessening arm sleeve moisture damage, a one-use underarm garment absorbent pads are in prevalent use, as exemplified by that described and illustrated in U.S. Pat. No. 2,742,193 for "DISCARDABLE UNDERARM GARMENT SHIELD" issued to Pulsifer on May 29, 1956. To serve their end purposes, the shield or pad construction material is of an absorbent nature and an underarm location is, for obvious reasons, a logical selection of a site of use. However, an underarm is also a location at which arm activity occurs; the arm undergoing clockwise and counter-clockwise pivotal transverses and the like.

In the noted patented article of manufacture and in all other known like products, no provision is made to accommodate arm activity and thus, during use and prior to disposal, the perspiration is absorbed and the perspiration-laden pad becomes a source of discomfort, not merely because its presence is felt but also because it inhibits the pivotal transversing arm. movements.

Broadly, it is an object of the present invention to provide an underarm perspiration pad overcoming the foregoing and other shortcomings of the prior art.

More particularly, it is an object to use to advantage the compressibility of the construction material of the pad, which is characterized by porosity and the like for moisture absorption to also undergo size reduction and expansion and thus offer the least resistance to arm movements during wearing use of the pad, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 6:
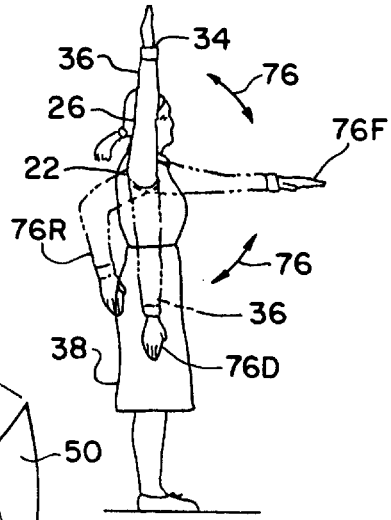
FIG. 6 is a side elevational view illustrating use of the underarm pad, with degrees of arm movement during such use shown in phantom perspective.
Figure 4:
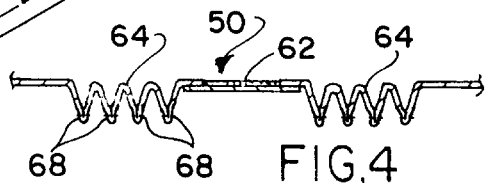
FIG. 4 is a sectional view taken along line 4—4 of FIG. 3.
Figure 5:
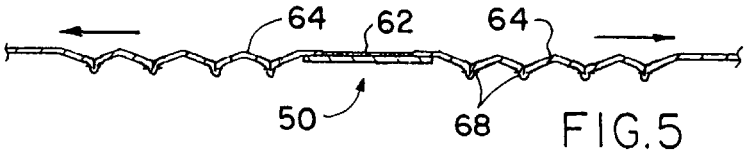
FIG. 5 is a view similar to FIG. 4, but illustrating pleats shown folded in FIG. 4 and in an unfolded condition in FIG. 5.
Figure 7:
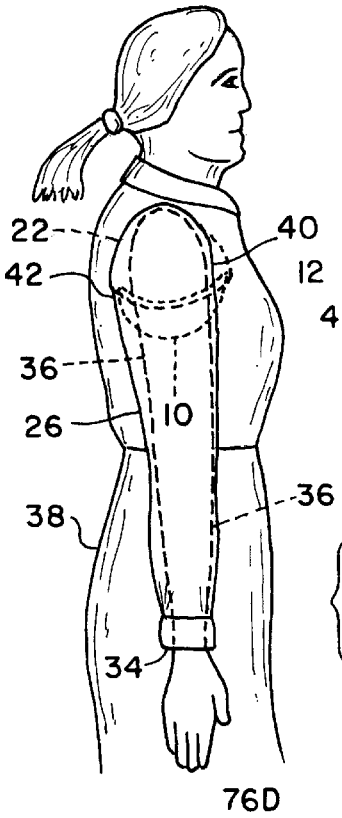
FIG. 7 is a view similar to FIG. 6, but illustrating in full line the down position of the arm illustrated in phantom in FIG. 6.
Figure 8:
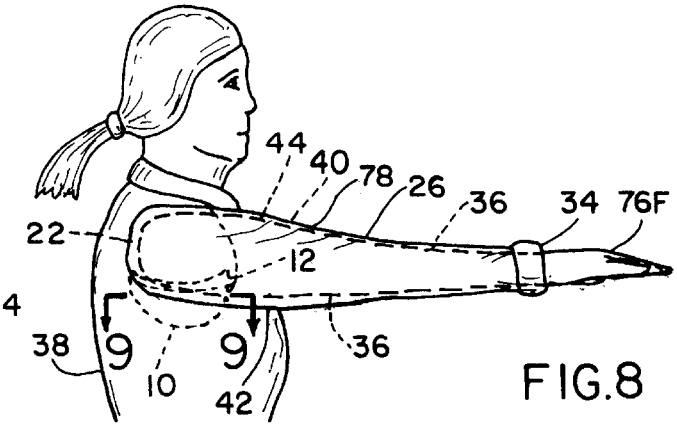
FIG. 8 is another view similar to FIG. 6, but illustrating in full line the horizontal position of the arm illustrated in phantom in FIG. 6.
Figure 9:
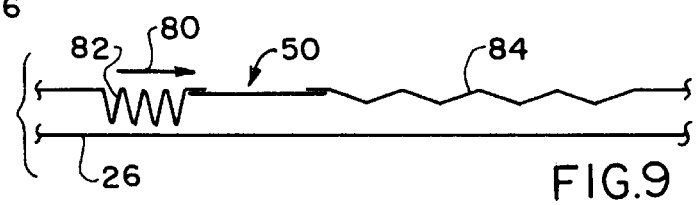
FIG. 9 is a schematic sectional view as taken along line 9—9 of FIG. 8 illustrating the folded and unfolded condition of pleats.
Figure 11:
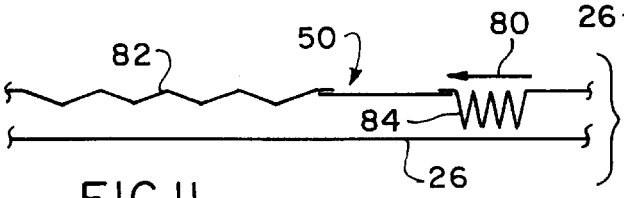
Figure 10:
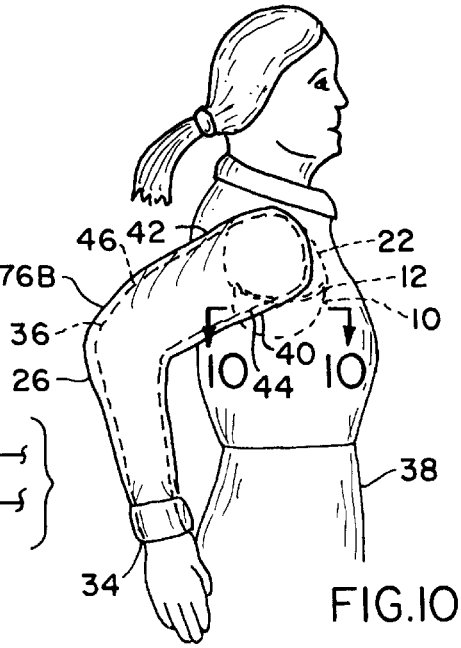

FIG. 10, similar to FIGS. 6, 7 and 8, illustrates still another arm position; and FIG. 11 is, like FIG. 9, another schematic sectional view, as taken along line 11—11 of FIG. 10.

Figure 1:
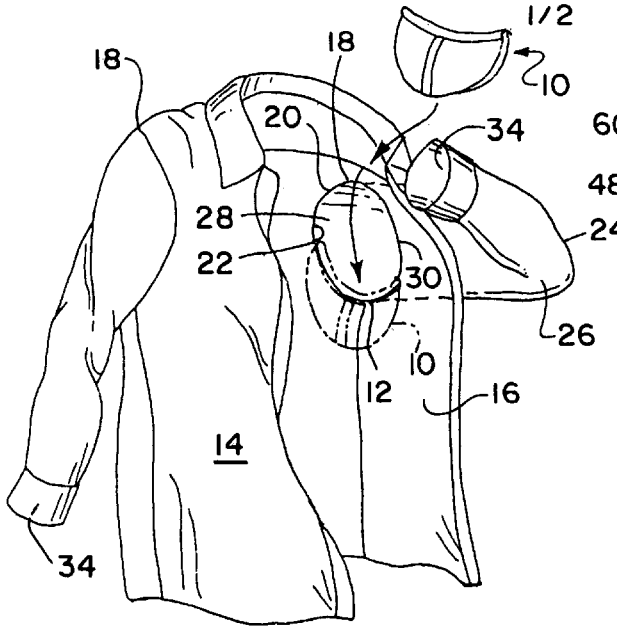
FIG. 1 is a perspective view of an upper torso garment having an underarm perspiration-absorbing pad according to the present invention.
Figure 3:
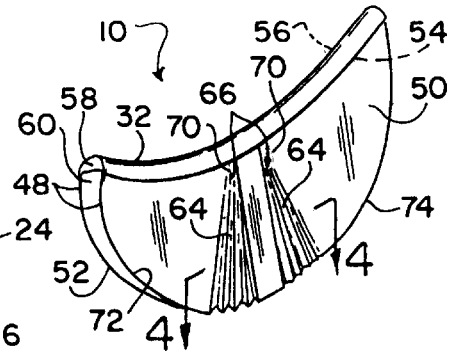
FIG. 3 is a view similar to FIG. 2 but illustrating the underarm pad in assembled condition.
Figure 2:
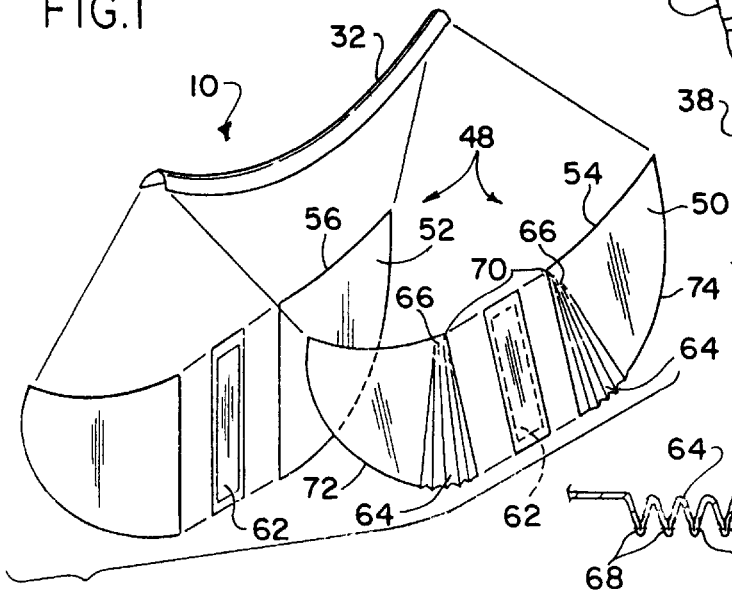
FIG. 2 is an isolated perspective view of the components of the underarm pad prior to assembly.

A perspiration-absorbing pad, generally designated 10, is illustrated in full line and phantom perspective in FIG. 1, operative in an underarm site of use 12 in an upper torso garment, such as a blouse 14, having in a side panel 16. A shoulder location 18 blouse 14 has a circular edge 20 bounding an inner sleeve opening 22 of an open-ended cylindrical body 24 serving as said sleeve 26, wherein one body end opening 28 is connected in an attaching seam 30 to the inner sleeve opening 22 so that extending outwardly therefrom the body is bounding of the noted arm-covering sleeve 26 and terminates in an opposite outer sleeve opening 34. In use, an arm 36 of a user 38 is projected through the inner and outer sleeve openings 22, 34 positioning the sleeve 26 therebetween with front 40 and rear 42 arm-covering body areas in adjacent relation to respective front 44 and rear 46 areas of a user's arm 36, the significance of the noted adjacent positioning of the areas 40, 44 and 42, 46, soon to be better understood as the description proceeds.

Using to advantage the established site of use 12 at the underarm location noted, is the noted perspiration-absorbing pad 10 which, in a preferred embodiment, is a cooperating pair 48 of semi-circular shaped plies 50 and 52 joined by a strip 32 at arcuate confronting edges 54, 56 and thusly constructed having an operative position, as noted at 58, in which the pad 10 is in a straddling relation 60 incident to adhesive securement at 62 of the arcuate edges 54, 56 to the sleeve attaching seam 30, in which one ply 50 is disposed in the sleeve 26 and the other ply 52 in the upper torso garment 14.

Completing the construction of the pad 10 is ply 50 in which are plural folding and unfolding pleats, individually and collectively designated 64, oriented radially, as at 66, in attachment 68 centrally, as at 70, in the ply 50 and sized to extend from the arcuate edges 54, 56 to the plies' peripheral edges 72, 74.

As best understood from FIGS. 6, 7, 8 and 10, there are degrees of movement, individually and collectively designated 76 in the user's arm 36 during normal activity, one exemplary degree of movement 76F being a forward pivotal traverse initially causing contact, as at 78, of the arm front area 44 against the sleeve front area 40 (FIG. 8) and, in a continuation of the traverse 76F the sleeve 26 is urged in the direction of the traverse which causes the sleeve rear 42 to engage the rear edge 72 of the ply 50 and to cause folding or closing movement 80 of the pleats 64. Similarly during the other degrees of arm movement, the initial pivotal transverse causes a trailing or pulled sleeve area to contact an edge of the ply 50 and a continuation of the pivotal traverse to further cause folding or closing movement of pleats. Thus, just as there is minimal resistance to arm movement 76F, there is minimal resistance to all typical arm movements caused by the underarm pad 10.

While the underarm pad 10 herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A perspiration-absorbing pad operative in an underarm site of use in an upper torso garment, A. said upper torso garment site of use comprising:

1. an upper torso garment having in a side at a shoulder location a circular edge bounding an inner sleeve opening 2. an open-ended cylindrical body having one end opening connected in an attaching seam to said inner sleeve opening with said cylindrical body in extending relation therefrom bounding an arm-covering sleeve terminating in an outer sleeve opening bounded by said cylindrical body opposite end opening; and 3. effective for receiving in projected relation therethrough an arm of a user so as to position said sleeve with said front and rear arm-covering body areas thereof in adjacent relation to respective front and rear areas of a user's arm; and B. said perspiration-absorbing pad comprising:

1. a cooperating pair of semi-circular shaped plies joined at arcuate confronting edges, 2. an operative position of said pad in a straddling relation incident to adhesive securement of said arcuate edges at a central location to said sleeve attaching seam for disposing one said ply in said sleeve and said other ply in said upper torso garment, 3. plural foldable pleats formed in an unfolded condition in a radial orientation centrally in said plies extending from said arcuate edges to peripheral edges thereof;

whereby degrees of movement of said user's arm in said sleeve causes a sleeve-pulling urging in movement of said sleeve rear in contact against said pad ply in said sleeve and said pleats on said contacted sleeve ply undergo closing movement to contribute to minimal resistance to arm movement.

* * * * *